United States Patent [19]

Klumpp, Jr.

[11] 4,137,602

[45] Feb. 6, 1979

[54] MULTIPURPOSE BUSHING AND APERTURE LOCKING SYSTEM

[75] Inventor: Ferdinand Klumpp, Jr., Mountainside, N.J.

[73] Assignee: Heyman Manufacturing Company, Kenilworth, N.J.

[21] Appl. No.: 850,548

[22] Filed: Nov. 11, 1977

[51] Int. Cl.[2] ..... B65D 55/00

[52] U.S. Cl. ..... 16/2; 24/73 P; 24/142; 174/153 G; 248/56; 285/194

[58] Field of Search ..... 16/2, 10 B; 174/65 G, 174/152 G, 153 G; 248/56; 24/141, 142, 73 P; 85/5 R, 32.1, 80, DIG. 2; 285/162, 194, 196, 338

[56] References Cited

U.S. PATENT DOCUMENTS

| | | | |
|---|---|---|---|
| 2,424,757 | 7/1947 | Klumpp, Jr. | 174/153 G |
| 3,245,428 | 4/1966 | Klimak et al. | 174/153 G |
| 3,516,111 | 6/1970 | Heyman | 16/2 |
| 3,631,738 | 1/1972 | Harper | 285/162 X |
| 3,918,667 | 11/1975 | Madden | 248/56 |
| 3,991,446 | 11/1976 | Mooney et al. | 16/2 X |

*Primary Examiner*—Louis Rimrodt
*Assistant Examiner*—Moshe I. Cohen
*Attorney, Agent, or Firm*—Auslander & Thomas

[57] ABSTRACT

A multipurpose bushing having maximum useable internal space has snap means outside the periphery of the bushing collar and spacers that fit in with round and flat sided apertures.

5 Claims, 9 Drawing Figures

FIG.1
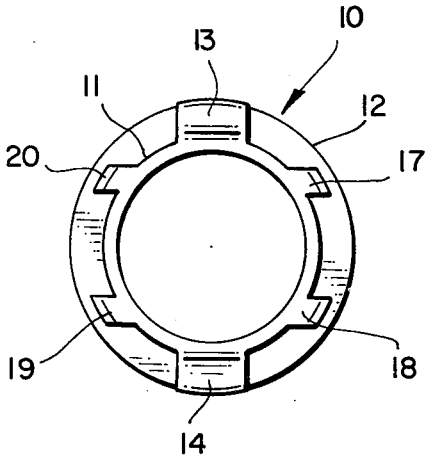
FIG.3
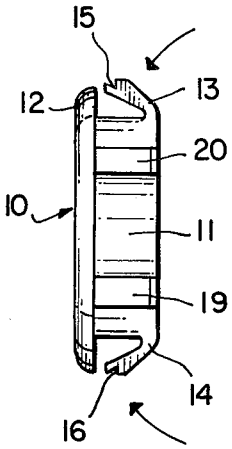
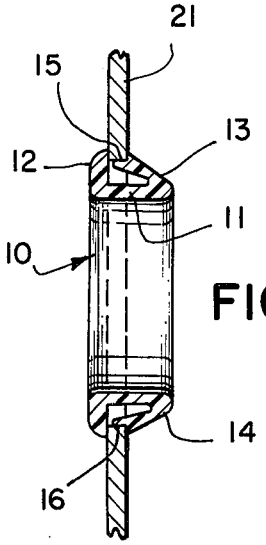
FIG.5
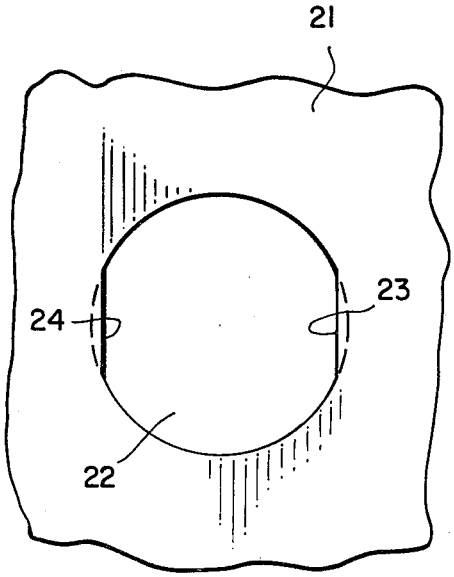
FIG.2
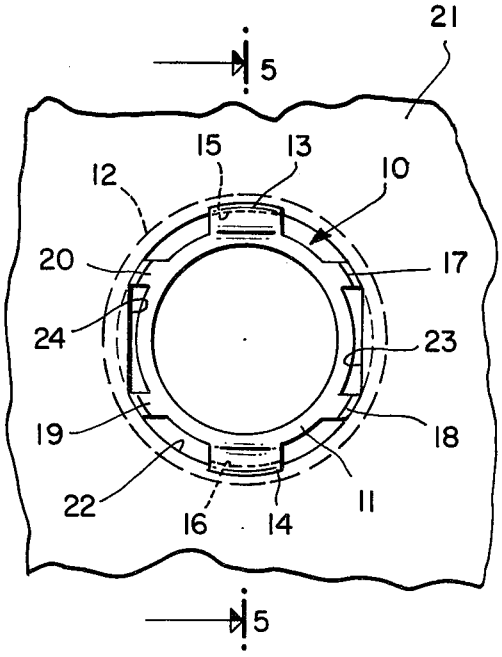
FIG.4

FIG.6
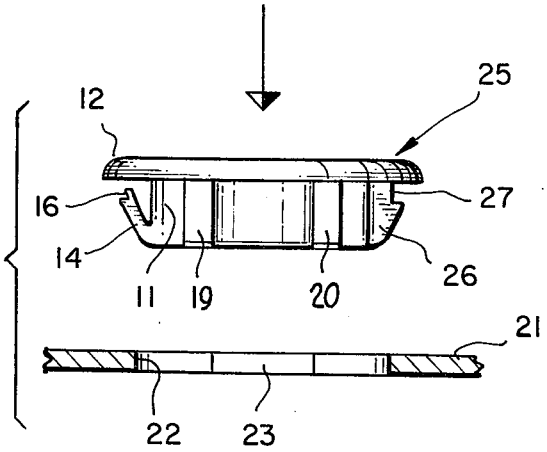
FIG.7
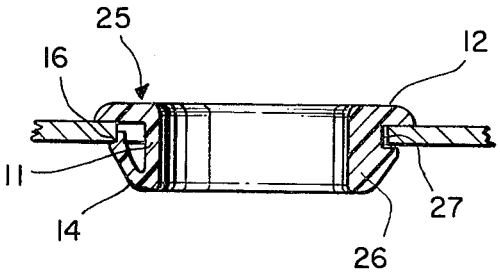
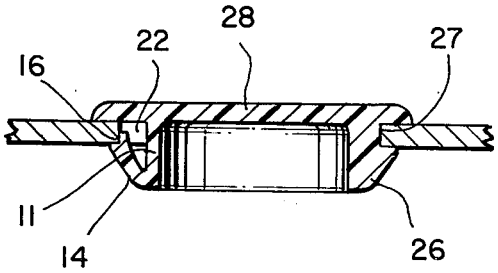
FIG.8
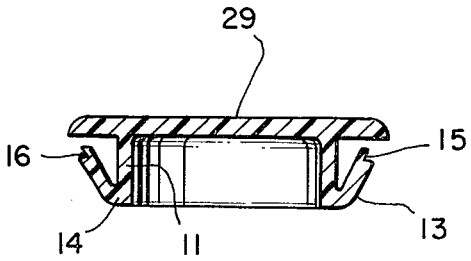
FIG.9

MULTIPURPOSE BUSHING AND APERTURE LOCKING SYSTEM

The present invention relates to an improved multipurpose bushing and its aperture locking system.

Bushings of the past have been provided with snap fingers in their collars which may flex inward into spaces in the collars as they are being inserted, then snap outward to grasp the walls of the aperture.

An advantage of such bushings is that they have a maximum useful inside space. A disadvantage is that there are openings or discontinuities in the collar not fully insulated between the collar and the walls of the aperture.

It has been found useful to provide bushings with flat sides; thus round bushings with flat sides may fit into rounded apertures with flat sides, the flat sides of the apertures, in effect, chords in the circle of the aperture. Thus, a single bushing may be rotatable or nonrotatable, depending upon the aperture and one bushing serves all apertures of its normal diameter.

A disadvantage of flat-sided bushings is that the flattening of the sides usually reduces the useable inside space of the bushing.

Where bushings have to be insulated, the openings in the collar for the snap fingers cannot be used, thus there must be some form of sacrifice of useable inside diameter or inside useable space. One solution of the past has been to provide a second inner collar in a snap bushing. The disadvantage of such a construction has been the cost of material to provide two collars and the loss of useable inside space. In the alternative, larger apertures may be necessitated in order to accommodate a bushing with the double collar and a desired useable inside space.

Another system found in U.S. Pat. No. 3,001,007 provided a 360° collar of maximum diameter. In order to accommodate such a collar, though the flange of the bushing had to be provided with gaps or discontinuities which were the equivalent to the gaps in the collar walls of the other systems, thus not fully providing the integrity and continuity of an unbroken flange and an unbroken inside portion, insulated from an aperture wall.

In order to provide an unbroken flange and a collar without a break, some form of a sacrifice must be made to have a gripping means outside the outer diameter of the collar. Where such gripping means is used, there is a gap between the gripping means and the outside diameter of the collar which is preferably filled by some form of spacer so that an engaged bushing is properly supported in the aperture.

The present invention utilizes the spacer so that the single bushing is fully supporting in an aperture and also adapted for full support and use in flat sided apertures without any further sacrifice of inside useable space.

According to the present invention, a simple inexpensive bushing is provided with a gripping means extending outside the periphery of an unbroken continuous bushing collar, the bushing including spacers to space the bushing in a round aperture or a round aperture with flat sides or chords.

An advantage of the present invention is that the simplicity of spacing and construction save material and cost thereby. Also, an optimum useable inside space is provided in a bushing that serves the double purpose of fitting in a round aperture and a round aperture with flat sides.

There is a cost saving in reducing the number of bushings that have to be handled, since a single bushing provides a maximum useable inside space and snaps into round apertures or round apertures with flat sides.

Although such novel feature or features believed to be characteristic of the invention are pointed out in the claims, the invention and the manner in which it may be carried out, may be further understood by reference to the description following and the accompanying drawings.

FIG. 1 is a rear elevation of a bushing of the present invention.

FIG. 2 is a front elevation of a flat-sided aperture.

FIG. 3 is a side elevation of FIG. 1.

FIG. 4 is a view of FIG. 2 with the bushing of FIG. 1 engaged.

FIG. 5 is a cross-sectional view of FIG. 4 taken along line 5—5.

FIG. 6 is an exploded view of another embodiment of the bushing of the present invention.

FIG. 7 is a section view of FIG. 6 with the bushing of the present invention engaged in an aperture.

FIG. 8 is a cross-section of another embodiment of the present invention engaged in an aperture.

FIG. 9 is another embodiment of the bushing of FIG. 8.

Referring now to the figures in greater detail, where like reference numbers denote like parts in the various figures.

The bushing 10 as shown in FIGS. 1, 3, 4 and 5 has a round collar 11 which has no breaks through its surface (it is continuous) and a round flange 12 which has no breaks in it. As exemplified in the drawing, snap fingers 13, 14 extend outwardly from the edge of the collar 11. The snap fingers include aperture engaging shoulders 15, 16. Spacers 17, 18, 19, 20 extend from outside the collar 11. The bushing 10 as shown in FIGS. 1, 3, 4 and 5 has a collar 11, a smooth inside continuous useable area and a smooth continuous flange 12, both important to protect against abrasion of conductors.

In FIG. 2, a conventional wall 21 is shown with an aperture 22 having flat sides 23, 24. In FIGS. 2, 4 the dots indicate the portion of a normally round aperture that has been filled in by the flat sides 23, 24. As can be seen in FIGS. 4 and 5, the bushing 10, inserted in the aperture 22, is held in by the fingers 13, 14, engaging the wall 21 of the aperture at the shoulders 15, 16 on one side, holding the flange 12 against the wall 21 on the other side. The snap means (fingers 13, 14) are preferably spaced a semicircle apart.

In FIG. 4, the positioning of the spacers 17, 18, 19, 20 can be seen when the bushing 10 is engaged in the aperture 22 in the wall 21. Spacer pairs 17, 18, 19 and 20 are spaced apart from each other a distance equal to the flat sides 23, 24 of the aperture 22. The spacers 17, 18, 19, 20 extend almost to a full radius of the aperture 22.

In FIGS. 6 and 7 a bushing 25 is shown illustrating another grasping means. The bushing 25, instead of having two sets of fingers 13, 14 has snap finger 14 and ramp 26 and a wall 21 engaging channel 27. The bushing 25 otherwise functions the same as bushing 10.

FIGS. 8 and 9 illustrate caps 28, 29 having the wall grasping configuration of the bushings 25 and 10, respectively.

In use, the bushings 10, 25, or caps 28, 29 are inserted in an aperture in the conventional manner. The aperture 22, with its flat sides 23, 24, stops rotation of the various bushings and caps 10, 25, 28, 29 since the spacers 17, 18, 19, 20 are radii for the basic circumference of the aperture 22. Thus, by being spaced apart the distance of the flat sides 23, 24, the spacers 17, 18, 19, 20 are able to fit into the aperture 22 without interfering with the distance shorter than the radius of the aperture 22 encountered over the flat surfaces of the sides 23, 24. The bushings 10, 25 and caps 28, 29 are non-rotatable in the aperture 22. Were the aperture 22 to be a full circle as indicated by the dotted line in FIGS. 3 and 4, the bushings 10, 25 and caps 28, 29 would just as amply fit within the aperture but would have no inhibition to rotation.

The spacers 17, 18, 19, 20 take up the distance between the collar 11 and the wall 21 in which the aperture 22 is found. Thus, the bushings 10, 25 and caps 28, 29 are firmly braced in the aperture 22 as well as in any round aperture in which they may be placed and have little free play once inserted.

The bushing 25 is exemplary of another configuration of snap means extending from an unbroken collar 11 outside the periphery of the collar 11.

The caps 28, 29 employ the same aperture locking means as the bushings 10, 25. The cap portions 28, 29 of the bushings 10, 25 are illustrative of types of bushings, normally insertable in apertures both of the round type and the round with flat sides.

The available useable space inward of the collar 11 in the bushings 10, 25 and the caps 28, 29 is substantially maximized by the snap construction outside the periphery of the collar 11. It is not as great as the useable space in bushings of the past having snap fingers flexing from breaks in the collar, nor is it as great as the useable space inside the collar of bushings made in accordance with the teachings of U.S. Pat. No. 3,001,007. The bushings of the present invention, though, have no breaks in their outer flange 12, nor in their collar 11. Thus, they have superior insulating characteristics since there is no opening from the bushing to the wall 21.

By having the spacers 17, 18, 19, 20 projecting from the collar 11, selected collar thickness for the needs of the bushing is provided without the need to use material to fill solid space with the concomittant additional cost of additional material. At the same time the spacing of the spacers 17, 18, 19, 20 functions to both fully space the bushings of the present invention in an aperture and allows such bushings to be fully interchangeable in both round apertures or round apertures with flat sides, thus giving the bushings of the present invention the advantage of maximum inside useable space, least material requirement and multipurpose in apertures.

While some form of spacing to compensate for the thickness of attaching fingers is to be expected in bushings having snap means of some sort outside the diameter of the collar, the particular placement of the spacers employs the well-known spacing means to perform the additional function of preventing aperture torque, giving a double purpose to the other utility of the bushing of the present invention.

It should be noted that since the outer diameter of collar 11 necessarily has to be reduced to accommodate the snap means which do not break the continuity of the collar 11, there is no further reduction in the diameter of the collar 11 necessitated by providing the spacers 17, 18, 19, 20 for their multipurpose function of spacing and nonrotatability in a flat-sided aperture. Ordinarily, in single purpose bushings some useable inner space would have to be lost in a bushing in order to provide the flat sides to make it multipurpose.

The terms and expressions which are employed are used as terms of description; it is recognized, though, that various modifications are possible.

It is also understood that the following claims are intended to cover all of the generic and specific features of the invention herein described, and all statements of the scope of the invention which, as a matter of language, might fall therebetween.

Having described certain forms of the invention in some detail, what is claimed is:

1. A multipurpose snap bushing including an outer flange, said outer flange of greater diameter than an aperture into which said bushing is insertable, said outer flange having no openings in its continuity, a collar extending from said outer flange, said collar of lesser diameter than said aperture, said collar having no openings in its continuity, snap means, said snap means adapted to engage the wall of said aperture and hold said bushing engaging said wall between said outer flange and said snap means, said snap means extending outwardly from the periphery of said collar, said snap means positioned to engage opposite sections of said aperture wall, and four spacers, said spacers extending from said collar a radius distance of said aperture, said spacers co-actable in pairs, the distance between two points on two edges of each of said pairs of said spacers defining a line approximately equal to the chord defined by the normally flattened sides of round apertures flattened to receive non-rotatable bushings.

2. The invention of claim 1 wherein said snap means are fingers.

3. The invention of claim 2 wherein said fingers include shoulders.

4. The invention of claim 1 wherein said snap means include a finger and a channel adapted to engage said aperture wall.

5. The invention of claim 1 wherein said outer flange includes a cap portion over said collar.

* * * * *